US005430425A

United States Patent [19]

Alber et al.

[11] Patent Number: 5,430,425

[45] Date of Patent: Jul. 4, 1995

[54] INTEGRATED FRAME SYSTEM

[75] Inventors: Friedrich Alber, Köngen; Rudolf Dedelmahr, Aichtal; Winfried Jungnitz, Weilheim-Egelsberg; Rudolf Link, Bissingen; Hans Schott, Lenningen; Siegfried Weiss, Bissingen, all of Germany

[73] Assignee: Siemens Aktiengesellschaft, München, Germany

[21] Appl. No.: 231,863

[22] Filed: Apr. 22, 1994

Related U.S. Application Data

[63] Continuation of Ser. No. 767,059, Sep. 27, 1991, abandoned.

[30] Foreign Application Priority Data

Sep. 28, 1990 [EP] European Pat. Off. ..... 90118717

[51] Int. Cl.[6] ..... H01F 27/26

[52] U.S. Cl. ..... 336/210; 336/67; 336/197

[58] Field of Search ..... 336/65–67, 336/90, 92, 98, 100, 134, 176, 210, 196–198, 233–234; 335/278

[56] References Cited

U.S. PATENT DOCUMENTS

| | | | |
|---|---|---|---|
| 3,671,903 | 6/1972 | Arrington et al. | 336/96 |
| 4,260,975 | 4/1981 | Wilcox et al. | 336/65 |
| 4,549,158 | 10/1985 | Mitsui et al. | 336/83 |
| 4,565,988 | 1/1986 | Moura et al. | 336/192 |
| 4,723,349 | 2/1988 | Grimes | 336/210 |
| 4,839,622 | 6/1989 | Hay | 336/92 |
| 4,890,086 | 12/1989 | Hill | 336/210 |
| 4,899,122 | 2/1990 | Sommer | 336/65 |

FOREIGN PATENT DOCUMENTS

| | | | |
|---|---|---|---|
| 1385054 | 11/1964 | France | 336/210 |
| 3325905 | 1/1985 | Germany | 336/210 |
| 0120823 | 9/1979 | Japan | 336/210 |
| 0058713 | 4/1983 | Japan | 336/210 |
| 0189109 | 7/1989 | Japan | 336/210 |
| 1121993 | 7/1968 | United Kingdom . | |
| 2129622 | 5/1984 | United Kingdom | 336/210 |

OTHER PUBLICATIONS

Trafo-Union GmbH, Nürnberg, DE, 1982, A-191-00-T1306-A13, GEAFOL Giessharztransformatoren (GEAFOL Cast-resin transformers) and translation thereof. (Month is not provided).

*Primary Examiner*—Bot Ledynh
*Attorney, Agent, or Firm*—Kenyon & Kenyon

[57] ABSTRACT

A clamping frame for a transformer core has a clamping frame part and a tensioner. The surfaces of the tensioner and of the clamping frame part abutting the transformer core lie in a common plane. The tensioner features an engagement part, which engages in a recess of the clamping frame part.

19 Claims, 3 Drawing Sheets

INTEGRATED FRAME SYSTEM

This application is a continuation of application Ser. No. 07/767,059, filed on Sep. 27, 1991, now abandoned.

BACKGROUND OF THE INVENTION

The present invention relates generally to integrated frame systems, and more particularly to an integrated frame system for a clamping frame of a transformer core.

As a rule, transformers, particularly power transformers, contain a transformer core formed by a stack of core laminations. The coils of the individual phases are configured on the leg of this transformer core. The coils can be encapsulated in casting resin. The part of the transformer core, e.g. yokes and legs, are held together by a clamping frame. The clamping frame consists of frame parts, in particular metal sections on both sides of the yokes, which are screwed to one another through the laminations. In addition, the frame parts of two transformer yokes are connected to one another by means of tensioners. The purpose of these tensioners is to brace the transformer along its leg and to affix the coils to the legs.

Trafo-Union publication A 19100-T1306-A13, page 3, illustration 2 discloses and illustrates in detail such a transformer. In particular, the exact construction of the clamping frame is shown. The tensioners consist of a metal band, which has a bolt that is supported in the frame part, at least at one end. A bolthead of an eye-bolt engages with this bolt and is secured by a clamping nut to the frame part. The clamping nut is used to adjust the tensile force at the tie-bolt. Separate tie-bolts are provided on both sides for each leg. In this manner, the frame pans of the clamping frame can be braced together with the core and the coils. The grid system between the tensioners and frame bars is costly, because many individual parts are needed. Producing the grid system is both labor and cost intensive.

GB-A-1 121 993 discloses a clamping frame in which the tensioner rests directly on one leg of the core and overlaps the frame parts in the vicinity of the yoke. In this variant, there is an unfavorable force control because of the tensioner, whereby tensioning the tensioner can cause it to lift off the leg. In addition, the tensioner is expensive to produce.

Thus, there is a need to develop an integrated frame system that requires less labor and cost to construct.

SUMMARY OF THE INVENTION

The present invention solves this problem for an integrated frame system by disposing one surface of the tensioner and a surface of the clamping frame part, both of which face the transformer core, in a common plane. A recess is formed in one of the two elements, and an engagement part is disposed in the other element which fits into the recess, with the recess and the engagement part also lying in the common plane. The present invention is based on the recognition that the prior art approaches are unfavorable from a mechanical standpoint.

In one embodiment of the present invention, the entire clamping frame rests uniformly on the transformer core, thereby attaining a uniform clamping. Therefore, filling material for the hollow spaces is superfluous, as are the additional machining operations otherwise required, when using prior art approaches.

Refinements of the clamping frame of the present invention are possible through mounting the surface of the tensioner and the surface of the clamping frame part on the transformer core like a flat overlay. The recess is then disposed in the clamping frame part and the engagement part is disposed on the tensioner. The engagement part can then be designed as a clasp engaging the recess. The clasp should have an engaging surface at least as large as the smallest cross-sectional area of the tensioner. The clamping frame part can also have a retaining cover for the tensioner lying in a plane spaced from the transformer core in the vicinity of the recess. Other refinements of the present invention are that the tensioner is manufactured from a flat metal piece, and the clasp lies in the same plane as the tensioner.

The construction and the manufacturing of the clamping frame part and the tensioner are simplified considerably, thus increasing their stability, and particularly their connecting stability. Also, the number of individual parts is reduced considerably, so that there is a decrease in the number of spare parts that have to be stocked for the integrated frame system. Ideally, the tensioner will consist of one piece of punched metal. The bolt, which had been critical, is no longer necessary.

An advantageous embodiment of the present invention uses a wedge to brace the coil on the frame part. The wedge can be inserted with a specific force, or along a specific insertion path. Thus, in a configuration comprised of several coils, all of the coils can be clamped easily and quickly with the same force. Differences in the coil sizes or tolerance deviations resulting from the coil assembly need not be accounted for.

An additional refinement of the present invention provides a coil disposed on a leg of the transformer core, and a clamping fixture bracing the coil, wherein the clamping fixture is a clamping bolt supported in the clamping frame part.

DETAILED DESCRIPTION

Figure 1:
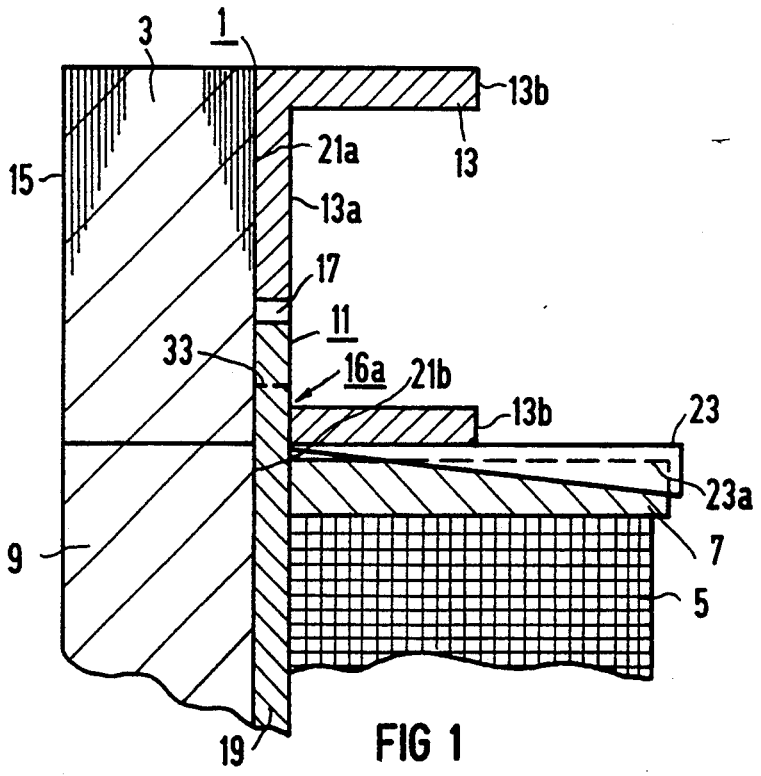
FIG 1 depicts a cut-away portion of a longitudinal section through a transformer with an integrated frame system.

FIG. 1 depicts a longitudinal section through a transformer 1. The transformer 1 comprises a transformer core 3 formed by a stack of core laminations, a coil 5 with coil support 7 disposed on a leg 9 of the transformer core 3, as well as a clamping frame 11. The clamping frame 11 includes a clamping frame part 13, which abuts against the yoke 15 of the transformer core 3. Only the clamping frame 11 on the right side of the yokes is shown. A similar clamping frame is also provided on the left side with the two connected together by bolts extending through the laminations. As depicted in FIG. 1, the clamping frame part 13 has a U-shaped sectional profile, with a base part 13*a* and two arms 13*b*. However, other section shapes or even a flat ribbon shape can be used as well. The clamping frame part 13 is a part of an integrated frame system 16*a*. The clamping frame part 13 has a recess 17 on its side abutting the transformer core 3 (see FIG. 3). The end of a tensioner 19, which rests against the leg 9, is disposed in this recess 17. The other end of tensioner 19 is connected to a clamping frame of the yoke at the bottom end of leg 9. The end of tensioner 19 is connected with an interference fit (i.e. friction-locked) to the clamping frame part 13, as best seen from FIG. 3.

Figure 3:
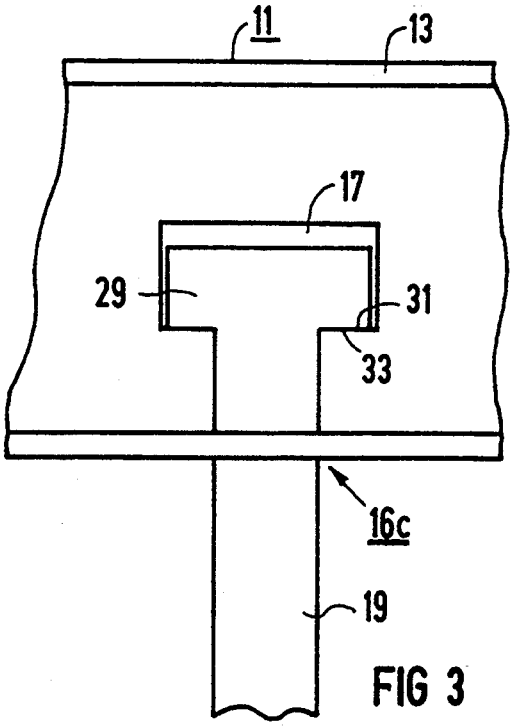
FIG. 3 depicts a side view of the integrated frame system according to FIG. 1.

FIG. 3 depicts a side view of the integrated frame system 16*c* according to FIG. 1. The tensioner 19 is configured with an engagement part 29 fitting in the recess 17 of the clamping frame part 13. The engagement part 29 has a clasp 31, which engages with a shoulder 33 of the recess 17. The engaging surface of the clasp 31 on the shoulder 33 should be at least as large as the smallest cross-sectional area of the tensioner 19. In this manner, a reliable transfer of force is provided without any damage to the engagement part 29.

In FIG. 1, the surfaces 21*a*, 21*b* of the tensioner 19 and the surface of clamping frame part 13 abutting the transformer core 3 lie in a common plane. The surfaces 21*a*, 21*b* lie flat on the transformer core 3. There are no hollow spaces between the clamping frame 11 and the transformer core 3. The clamping and bracing of the transformer core 3 is thus improved. The tensile and tensional forces arising between the clamping frame part 13 and the tensioner 19 lie advantageously in the plane of the tensioner 19. The integrated frame system 16*a* consists of only two elements. This leads to a reduction in the number of spare parts that have to be stocked. The elements are also very easy to manufacture, since they can be fabricated from standard shapes in just a few simple machining operations.

To brace the coil 5 in the axial direction, a wedge 23 is disposed between the coil 5 and the clamping frame part 13. The wedge is used as a clamping fixture. The wedge 23 is preferably inserted with a specified force. Inserting the wedge is also possible by pressing in the wedge along a specified insertion path. Thus, even when the dimensions of the coil 5 and the clamping frame part 13 deviate, the same bracing force can always be maintained. The wedge 5 can be provided with a self-locking or slip-restraining surface or wedge slope. As an additional safeguard, an enamel protective coating or cotter-pin can be provided, for example. For each coil 5, several wedges 23 are used per clamping frame part 13. The wedge 23 is preferably arranged in a recess 23*a* of the coil support 7. Thus, the wedge 23 is guided laterally and, moreover, it lies flat on the clamping frame 13. As a result, the bracing action is improved. Also, the coil form itself can constitute the coil support 7.

Figure 2:
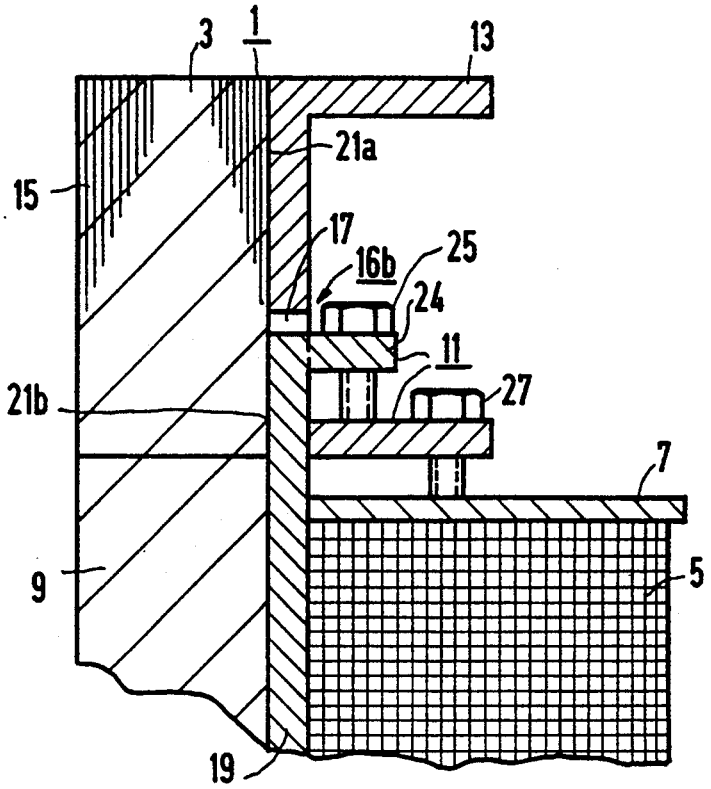
FIG. 2 depicts a second exemplified embodiment of an integrated frame system.

FIG. 2 depicts another embodiment of an integrated frame system 16*b* according to the present invention. In FIG. 2, the tensioner 19 has a bend 24 at its end with an adjusting screw 25 thread into the bend 24 and pressing against the clamping frame part 13. In this manner, the tensile force between the tensioner 19 and the clamping frame part 13 can be variably adjusted. A clamping bolt 27, which is threaded through and supported in the clamping frame part 13, is provided as a clamping fixture for the coil 5. This clamping bolt 27 clamps the coil 5 and the clamping frame part 13 together. As already described above, as an additional safeguard, an enamel protective coating or cotter-pin can be provided here as well.

Figure 4:
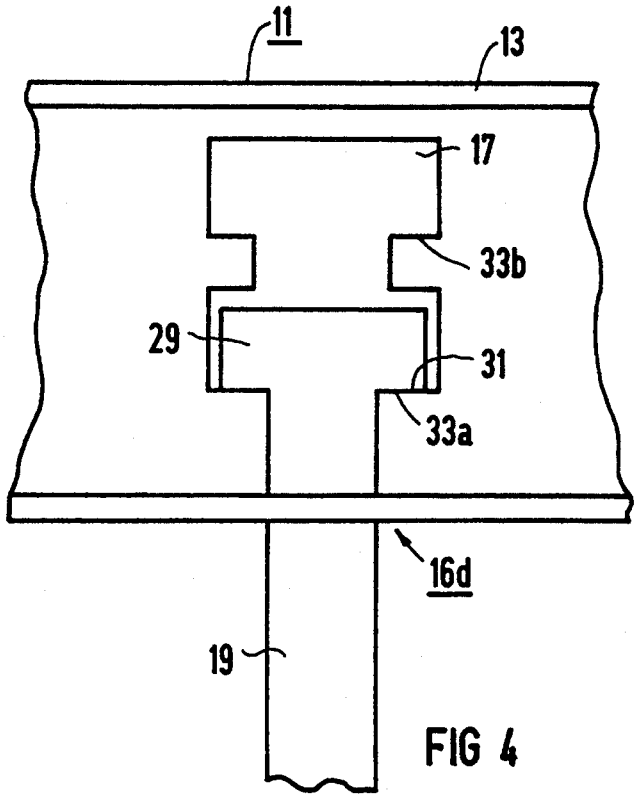
FIG. 4 depicts a side view of an integrated frame system showing its adjustability.

FIG. 4 shows a variation 16*d* of the integrated frame system, which has the additional feature of being adjustable. For this purpose, the recess 17 has several shoulders 33*a*, 33*b*, which lie one behind the other, making it possible for the engagement part 29 to be arranged in several different positions. As a result, the frame grid system 16*d* can be adjusted to different transformer sizes or varying tensile forces.

Figure 5:
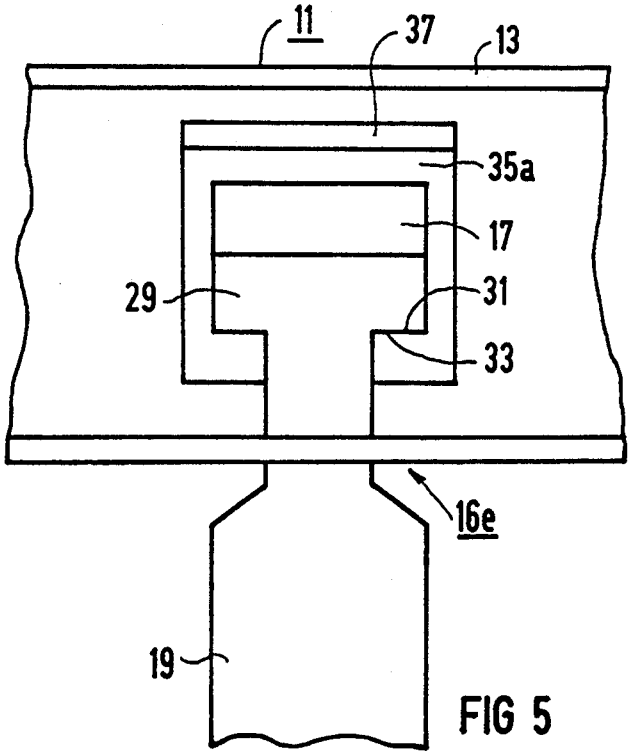
FIG. 5 depicts a side view of an integrated frame system with a spacer element.

FIG. 5 depicts another variant 16*e* of the integrated frame system. The recess 17, in which the engagement part 29 engages properly, is provided in a spacer element 35*a*, which in turn is arranged in an opening 37 of the clamping frame part 13. Through the use of spacer elements 35*a* of various sizes, the tensile force of the frame grid system 16*e* can be adjusted.

Figure 6:
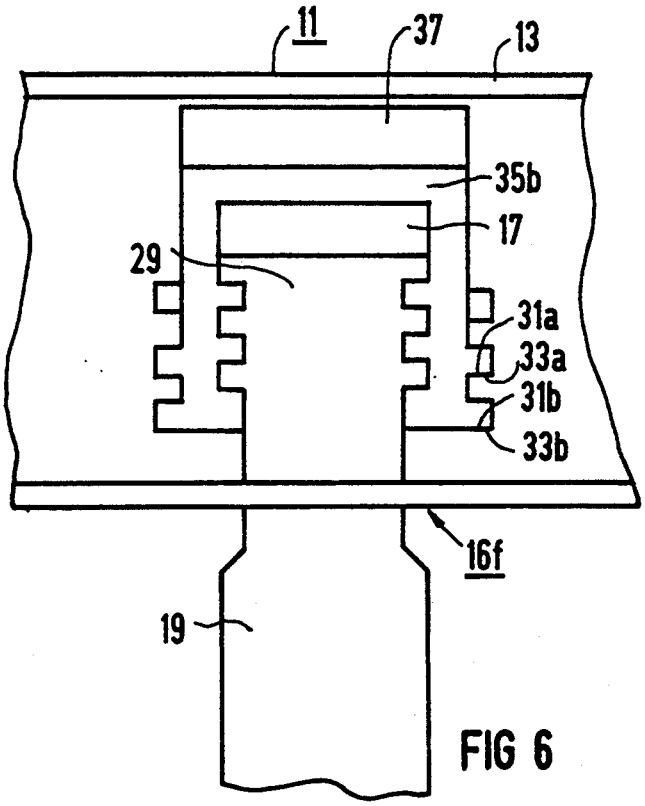
FIG. 6 depicts an additional integrated frame system with a spacer element.

FIG. 6 depicts an integrated frame system 16*f* in a combination of the variants of FIG. 4 and FIG. 5, in which, the spacer element 35*b* is configured so as to be adjustable in the opening 37. For this purpose, the spacer element 35*b* features clasps 31*a*, 31*b*, which lie one behind the other and which engage with the shoulders 33*a*, 33*b*. The spacer element 35*a*, 35*b* of FIG. 5 and FIG. 6 can also be used to compensate for tolerances existing in the transformer core 3 or the frame grid system 16*e* to 16*g*.

Figure 7:
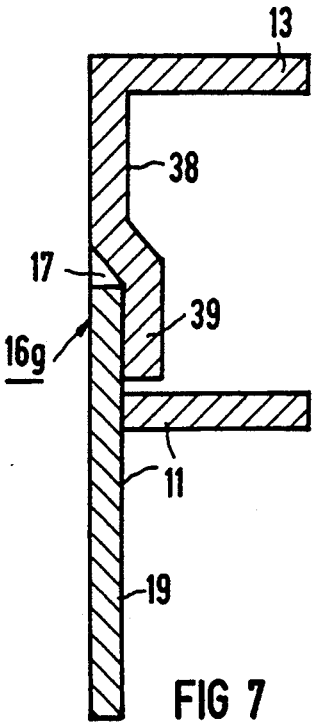
FIG. 7 depicts a longitudinal section of an integrated frame system with a retaining cover.

FIG. 7 depicts a longitudinal section of a refinement of the integrated frame system 16*g*, in which the clamping frame part 13 features a retaining cover 39 for the tensioner 19 in a plane abutting the surface 38 abutting the transformer core 3 in the vicinity of the recess 17. In this manner, the tensioner 19 is safeguarded even during assembly to prevent canting, slipping or twisting in the recess 17. From a production engineering standpoint, this refinement can be easily manufactured by pressing through or punching the material that would normally be removed from the clamping frame part 13 to create the recess 17 to form the retaining cover 39.

In the various designs, the tensioner 19 can be developed in different ways. The engagement part can be given whatever form is needed. As depicted in FIGS. 3 and 4, it can be secured to the tensioner 19, e.g. by welding, or as depicted in FIGS. 5 and 6. The tensioner 19 can be shaped as a wide flat band with appropriate cutouts made near the ends of the band to form engagement parts. Of course, combinations of the various disclosed alternatives can be made by one skilled in the art, particularly combining the integrated frame system with various clamping fixtures for the coil.

What is claimed is:

1. A clamping frame for use in clamping a transformer core, comprising an integrated frame system including:

a) a first element comprising a clamping frame part having a surface abutting the transformer core;

b) a second element comprising a tensioner having a surface abutting the transformer core in a common plane with said surface of said clamping frame part;

c) a recess formed in one of said elements; and d) an engagement part fitting into said recess formed in the other element, whereby surfaces of said recess and said engagement part at least partially lie in the common plane.

2. The clamping frame according to claim 1, wherein said surface of said tensioner and said surface of said clamping frame part are flat overlays mountable on the transformer core.

3. The clamping frame according to claim 1, wherein said recess is formed in said clamping frame part and said engagement part is disposed on said tensioner.

4. The clamping frame according to claim 3, wherein said engagement part comprises a clasp engaging said recess.

5. The clamping frame according to claim 4, wherein said clasp further comprises an engaging surface corresponding to the smallest cross-sectional area of said tensioner.

6. The clamping frame according to claim 4, wherein said clamping frame part further comprises a retaining cover for said engaged part disposed adjacent a surface of said engagement part facing away from said transformer core, in the vicinity of said recess.

7. The clamping frame according to claim 4, wherein said tensioner is manufactured from a flat metal piece, and said clasp lies in a plane of said tensioner.

8. The clamping frame according to claim 1, further comprising an opening in said clamping frame part, said clamping frame part comprising a spacer element disposed in said opening, said recess formed in said spacer element.

9. The clamping frame according to claim 8, wherein said spacer element is disposed in said opening such as to be adjustable in the tensile direction of said tensioner.

10. The clamping frame according to claim 1, further comprising a coil disposed on the transformer core, wherein said clamping frame part further includes a clamping fixture bracing said coil.

11. The clamping frame according to claim 10, wherein said clamping fixture comprises a clamping bolt supported in said clamping frame part.

12. The clamping frame according to claim 11, wherein said clamping fixture comprises a wedge disposed between said clamping frame part and said coil.

13. The clamping frame according to claim 12, wherein the wedge is insertable with a specifiable force between said clamping frame part and said coil.

14. The clamping frame according to claim 1, further comprising:

a) two transformer legs each having a coil wound around them, wherein said tensioner lays flush against one of said transformer legs; and b) a yoke between said two transformer legs, wherein said clamping parts is attached to said yoke.

15. In a frame grid system including a clamping frame for a transformer which includes at least one clamping frame part and at least one tensioner which is coupled to the clamping frame part, the tensioner and the clamping frame part being first and second elements, the improvement comprising:

a) a recess formed in one element; and b) an engagement part disposed on the other element, whereby said engagement part fits in said recess such that, at the location where said engagement part fits in said recess, the one element has a surface abutting a surface of said transformer core in a plane common with a surface of the other element.

16. The frame grid system according to claim 15, wherein said recess is formed in said clamping frame part and said engagement part is disposed on said tensioner, whereby said tensioner lays flush against the transformer.

17. A method of attaching two elements of an integrated frame system of a transformer, comprising the steps of:

a) forming a recess in one element; and b) providing an engagement part on the other element, whereby said engagement part fits in said recess such that, at least in the area of said recess and said engagement part, the one element has a surface abutting a surface of said transformer core in a common plane with a surface of the other element.

18. The method according to claim 17, wherein one element comprises a clamping frame part and the other element comprises a tensioner, whereby said tensioner is mounted flush against said transformer.

19. The method according to claim 18, wherein said step of forming the recess further comprises forming the recess in the clamping frame part.

* * * * *